United States Patent [19]

Bell

[11] Patent Number: 4,676,163

[45] Date of Patent: Jun. 30, 1987

[54] DOUBLE-PATH DETONATION TUBE INERTIA IGNITER

[75] Inventor: Frank H. Bell, Logan, Utah

[73] Assignee: Morton Thiokol, Inc., Chicago, Ill.

[21] Appl. No.: 643,122

[22] Filed: Aug. 22, 1984

[51] Int. Cl.[4] ..... F42C 1/04; F42C 19/08

[52] U.S. Cl. ..... 102/204; 102/275

[58] Field of Search ..... 102/204, 252, 272, 275, 102/396

[56] References Cited

U.S. PATENT DOCUMENTS

| | | | |
|---|---|---|---|
| 790,401 | 5/1905 | Semple | 102/252 |
| 1,311,678 | 7/1919 | Cartwright | 102/252 |
| 1,369,476 | 2/1921 | Semple | 102/272 |
| 2,516,234 | 7/1950 | Midgley et al. | 102/275 |

FOREIGN PATENT DOCUMENTS

| | | | |
|---|---|---|---|
| 5338 | of 1913 | United Kingdom | 102/204 |

*Primary Examiner*—Charles T. Jordan

*Attorney, Agent, or Firm*—Gerald K. White

[57] ABSTRACT

A chisel point striker is retained by a shear pin on the center line of a warhead above an open-ended flash tube packed with a percussion sensitive priming mixture. Impact of the warhead with a resistant target causes the shear pin to shear and the striker to impact the target violently thereby to set off the priming mixture. The resulting blast wave is communicated via two paths in opposite directions to two separate detonation wave acceptors or boosters. Each booster accepts the detonation wave and communicates a detonation reaction to a main explosive charge of the warhead.

17 Claims, 3 Drawing Figures

DOUBLE-PATH DETONATION TUBE INERTIA IGNITER

BACKGROUND OF THE INVENTION

1. Field of the Invention

The present invention relates to an improvement in explosive devices, and more particularly, concerns a redundant flame path inertia igniter for cannon and rocket projectiles or warheads that is not armed until impact with a resistant target.

2. Description of the Prior Art

The final functioning of a projectile or warhead is controlled by an explosive device commonly termed a fuze, initiator or igniter. Such a device normally has elements to set off the projectile, to prevent its premature functioning, and to cause it to function as desired only under predetermined conditions. These conditions determine the type of device that is needed. A general requirement for such devices, however, is that they shall normally be inactivated or desensitized for safe handling, transportation and storage.

Impact explosive devices are ones which function as they hit the target. Particular requirements for this type of explosive device is that it shall be nonresponsive to the forward motion and axial rotation, if any, of the warhead resulting from being shot or otherwise launched toward a target and that it shall be set off or detonated upon impact of the warhead with the target.

Inertia impact igniters are known in the prior art, one such form of igniter being disclosed in my copending application bearing Ser. No. 453,317, filed Dec. 27, 1982, now U.S. Pat. No. 4,515,080 and entitled "Inertia Type Friction Initiator for Rotating Projectiles." There exists a need, however, for a dual or redundant flame path inertia igniter for warheads that are not armed until impact.

SUMMARY OF THE INVENTION

An object of the invention is to provide a redundant flame path igniter for warheads that is not armed until impact.

Another object of the invention is to provide such an igniter that is very simple in construction having only one moving part and no springs.

In accomplishing these and other objectives of the invention, there is provided a chisel point striker that is retained by a shear pin on the center line of the projectile, the shear pin being provided to guard against accidental discharge. The striker is centered above an open-ended tube that is packed with a percussion sensitive priming mixture. Upon impact of the projectile with a resistant target medium, the shear pin is severed thereby releasing the striker and allowing it, as the result of inertia, to impact the primer tube violently. This sets off the priming mixture and the blast wave generated is communicated by way of two paths to two separate detonation wave acceptors or boosters. Each booster accepts the detonation wave and communicates a detonation reaction to a main explosive charge of the warhead.

BRIEF DESCRIPTION OF THE DRAWINGS

Having summarized the invention, a detailed description follows with reference being had to the accompanying drawings which form part of the specification wherein.

DESCRIPTION OF THE PREFERRED EMBODIMENT

Figure 1:
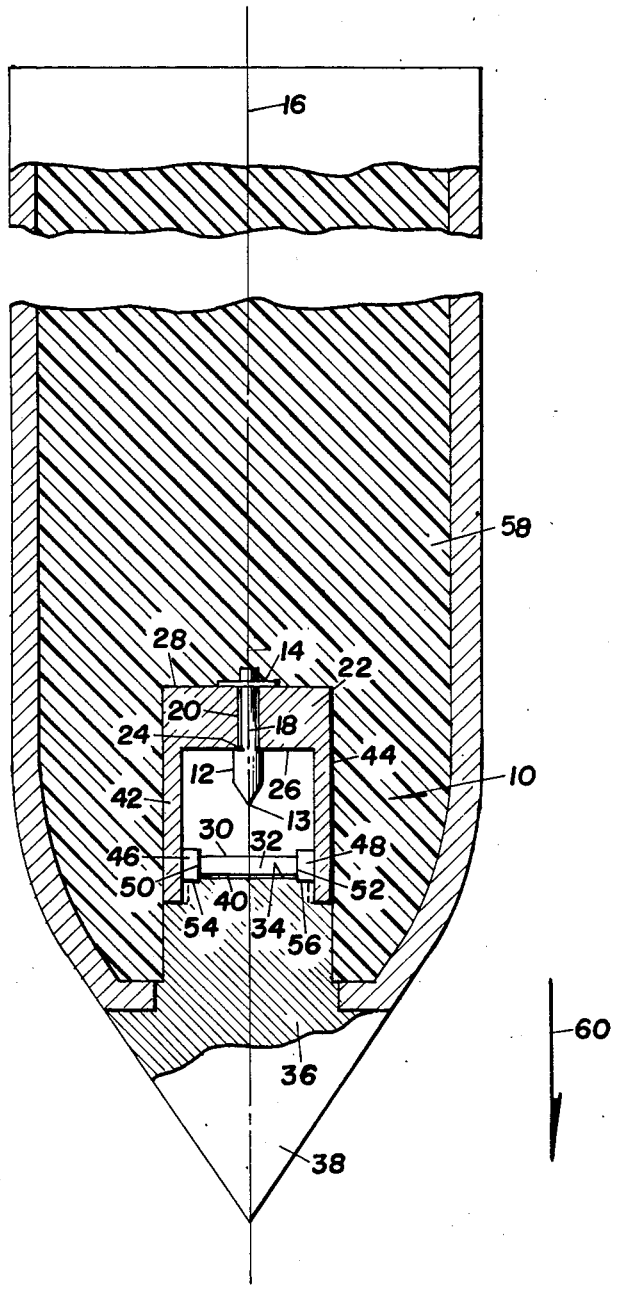
FIG. 1 is a fragmented cross-sectional view of a projectile or warhead having the double-path detonation tube inertia igniter according to the present invention installed therein.
Figure 2:
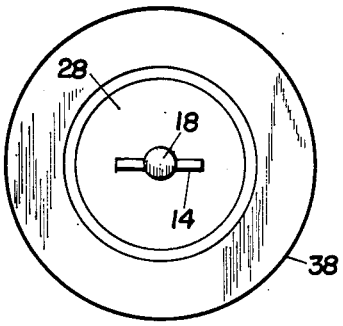
FIG. 2 is a plan view of the igniter of FIG. 1.

There is provided in the preferred embodiment of the invention, illustrated in the drawings, a doublepath detonation tube inertia igniter for cannon and rocket warheads. The igniter is designated generally by a reference numeral 10, and as those skilled in the art understand, may be installed in either the forward end or base of a warhead. The igniter 10, in FIG. 1, is shown installed in the forward end of a warhead 1 and includes a chisel point striker 12. Striker 12 comprises an inertial mass and is retained by a shear pin 14 on the center line, indicated at 16, of warhead 1, the center line 16 being parallel to the direction of launching of the warhead 1. A shaft portion 18 on the aft end of striker 12 extends through a hole or opening 20 in a first structural support member 22 that forms part of igniter 10, the hole 20 being located on the center line 16 of warhead 1. A shoulder 24 on striker 12 engages a forward surface 26 of the support member 22 and the shear pin 14 engages an aft end surface 28 of the member 22 to retain the striker 12 in hole 20, with the chisel point 13 facing forwardly, against accidental release and activation of igniter 10.

Striker 12 is centered above an open-ended detonation or flash tube 30 an intermediate portion of which is interesected by the center line 16 of warhead 1 and packed with a percussion sensitive priming mixture 32. Tube 30 is mounted on a flat surface 34 of a second structural support member 36 having a pointed forward portion 38 that may serve as an ogive for the warhead 1, being attached to a forward portion of the warhead 1 as by threaded engagement or in any suitable manner. Tube 30 is positioned substantially perpendicularly to the center line 16 and is firmly attached to the surface 34, as by a suitable adhesive 40. Structural support members 22 and 36 desirably may be rigidly attached to each other, as by a suitably thin cylindrical metallic wall 42, which wall, together with members 22 and 36, form an enclosure or housing 44 for igniter 10. Housing 44, if desired, may be hermetically sealed.

Also mounted on the surface 34 of member 36 are two detonation wave acceptors or booster 46 and 48, in pellet form with one booster 46 positioned in line with a first end 50 of open-ended tube 30 and with the other booster 48 positioned in line with the second end 52 of tube 30. Each of boosters 46 and 48 may, if desired, be positioned immediately adjacent its associated end 50 and 52 of flash tube 30, as shown in FIG. 1, and may be firmly attached to surface 34 of member 36 by a suitable associated adhesive indicated at 54 and 56, respectively.

By way of example and not limitation, it is noted that the percussion sensitive primary mixture 32 may be of a type common to the art and may include the following constituents, in the proportions noted:

a. Primary sensitive agents—approximately 50% by weight lead azide or lead styphnate b. Binder—5–10% by weight Gum arabic, shellac or any stable varnish c. Fuel—about 10% by weight Aluminum powder or magnesium powder d. Oxidant—the remainder of the mixture Tetracene Similarly, the detonation wave acceptor or booster pellets 46 and 48 may be made of blast sensitive material such as Tetryl, PETN, lead azide or lead styphnate.

The main charge, indicated at 58 in FIG. 1, of the warhead may consist of TNT, RDX plus wax or HMX plus wax.

Figure 3:
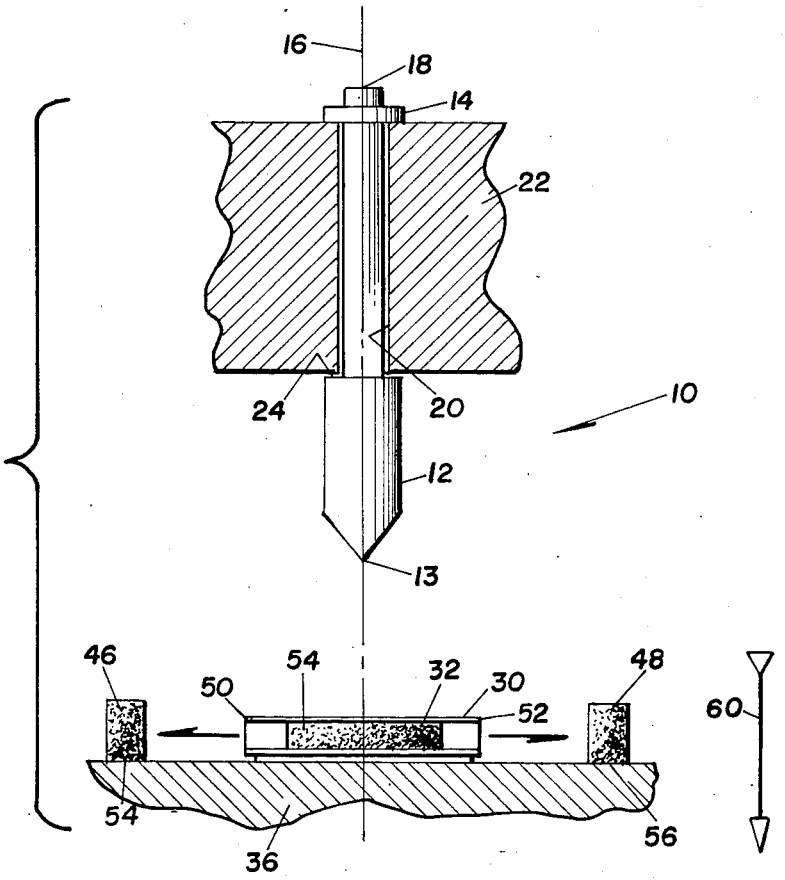
FIG. 3 is a schematic sectional view of the igniter of FIG. 1.

Upon launch of a warhead 1 in the direction of the arrow indicated at 60 in FIGS. 1 and 3, the inertia load of striker 12 created by acceleration is carried by engagement of striker shoulder 24 with member 22. Upon warhead impact with a resistant target, this inertia load is reversed and is of such magnitude that the shear pin 14 is unable to carry it. As a result, the striker 12 flies forward and impacts the detonation tube 30 violently. The percussion sensitive priming mixture 32 is ignited by the striker impact, and the mixture 32 is consumed. A detonation wave moves via two paths to each of the separate boosters 46 and 48. Each booster 46 and 48 accepts the incident detonation wave and communicates a detonation reaction to the main explosive charge 58 of the warhead, the metallic wall 42 transmitting the detonating shock to the charge 58.

Thus, in accordance with the present invention, there has been provided an improvement in inertia type impact igniters for warheads that features redundant charge initiation by the way of independent booster charges 46 and 48. The improved igniter is characterized in that it requires only one moving part, the striker 12, and has no springs, and remains in a safe condition while being handled, transported and stored until launched at a velocity, which, relative to the intended target, is adequate to shear the shear pin 14 and to initiate the percussion primer mixture 32.

What is claimed is:

1. A double path detonation tube inertia igniter for a warhead, said warhead having a center line that is parallel to the direction of launch thereof, comprising:

a first support member positioned transversely to the center line of the warhead, said support member having an opening therein coincident with the warhead center line and having an aft surface and a forward surfacing with the forward surface facing in the direction of the launch of the warhead, shear pin means, an elongated striker having an aft end and a forward end, said striker having a shoulder formed thereon, and having at least a portion thereof positioned in the opening in said first support member with said shoulder in engagement with the forward surface of said member, said striker being normally retained in said opening by engagement of said shear pin means with the aft end of said striker.

a second support member positioned transversely to the center line of the warhead, said second support member being rigidly attached to said first support member and having a surface that is substantially perpendicular to the center line of the warhead, said surface facing oppositely to the direction of launch of the warhead, an open-ended tube attached to the said surface of said second member with an intermediate portion thereof on the center line of the warhead, said open-ended tube having an open end at each end thereof and containing a percussion sensitive priming mixture, and at least two detonation wave acceptors attached to the said surface of said second member with one of said acceptors positioned in line with one open end of said open-end tube and with the other one of said acceptors positioned in line with the other open end of said open-ended tube, whereby upon launch and subsequent impact of the warhead with a resistant target, said shear pin means is sheared to release said striker, and as a result of inertia, said striker impacts said open-ended tube to set off the percussion sensitive priming mixture to produce a blast wave, said blast wave being communicated by separate paths to said separate acceptors, said acceptors being thereby activated to communicate a detonation reaction to a main explosive charge of the warhead.

2. An igniter as defined by claim 1 wherein each of said detonation wave acceptors comprises a booster pellet.

3. An igniter as defined by claim 2 wherein each of said booster pellets consists essentially of Tetryl.

4. An igniter, as defined by claim 2 wherein each of said booster pellets consists essentially of PETN.

5. An igniter as defined by claim 2 wherein each of said booster pellets consists essentially of lead azide.

6. An igniter as defined by claim 2 wherein each of said booster pellets consists essentially of lead styphnate.

7. An igniter as defined by claim 2 wherein said igniter is housed within a thin walled metallic housing, and wherein each of said booster pellets is positioned between the inner wall of said housing and its associated end of said open-ended tube, in physical contact therewith.

8. An igniter as defined in claim 1 wherein said striker comprises an inertia mass and has a chisel point on the end thereof facing said open-ended tube.

9. An igniter as specified in claim 8 wherein each of said detonation wave acceptors comprises a booster pellet, and wherein said igniter is housed within a housing having an inner wall with each of said booster pellets positioned between the inner wall of said housing and the associated end of said open-ended tube, in physical contact with both said inner wall and said open-ended tube.

10. An igniter as defined by claim 9 wherein said booster pellets consist essentially of Tetryl.

11. An igniter as defined by claim 9 wherein said booster pellets consist essentially of PETN.

12. An igniter as defined by claim 9 wherein said booster pellets consist essentially of lead azide.

13. An igniter as defined by claim 9 wherein said booster pellets consist essentially of lead styphnate.

14. A double-path detonation tube inertia igniter for a warhead, said warhead having a center line that is parallel to the direction of launch thereof, comprising:

a first support member having a first surface that is transverse to the center line of the warhead and faces in the direction of launch thereof, said support member having an opening therein that is coincident with the center line of the warhead, said first support member having a second surface facing oppositely to the direction of warhead launch, shear pin means, an elongated striker having an aft end and a forward end with said forward end facing in the direction of warhead launch, said striker having a shoulder formed thereon and having a portion thereof positioned in the opening in said first support member with said shoulder in engagement with said first surface of said first support member, said striker being normally retained in said opening by engagement of said shear pin means with the aft end of said striker, a second support member positioned transversely to the center line of the warhead, said second support member being rigidly attached to said first support member and having a surface that faces substantially oppositely to the direction of warhead launch, an open-ended tube attached to said surface of said second member in a suitable manner with an intermediate portion thereof intersected by the center line of the warhead, said open-ended tube having an open end at each end thereof and containing a percussion sensitive priming mixture, said percussion sensitive primary mixture consisting essentially of a primary sensitive agent in an amount approximately 50% by weight, a suitable binder in an amount 5–10% by weight, a fuel in an amount of about 10% by weight, and the remainder an oxidant, opposed detonation wave acceptors attached to the said surface of said second support member with one of said acceptors positioned in line with one open end of said open-ended tube and with the other of said acceptors positioned in line with the other open end of said open-ended tube, said detonation wave acceptors being attached to said surface of said second member in a suitable manner, and a thin walled housing in which said igniter is contained, said housing having an inner wall, both of said opposed acceptors being in physical contact with an individually associated portion of said inner wall, whereby upon launch and subsequent impact of the warhead upon a resistant target, said shear pin means is severed to release said striker which as a result of inertia impacts said open-ended tube to set off the percussion sensitive priming mixture to produce a blast wave, said blast wave being communicated by separate paths to said separate acceptors which are thereby activated to communicate a detonation reaction through the wall of said container to a main explosive charge of the warhead located externally of the housing.

15. An igniter as defined by claim 14 wherein said striker comprises an inertial mass and has a chisel point on the end thereof facing said open-ended tube, and wherein each of said detonation wave acceptors comprises a booster pellet.

16. An igniter as defined by claim 15 wherein said booster pellets consist essentially of Tetryl.

17. An igniter as defined by claim 15 wherein said booster pellets consist essentially of PETN.

* * * * *